US010316861B2

(12) United States Patent
Freeman et al.

(10) Patent No.: US 10,316,861 B2
(45) Date of Patent: Jun. 11, 2019

(54) TWO-PIECE MULTI-SURFACE WEAR LINER

(71) Applicant: United Technologies Corporation, Farmington, CT (US)

(72) Inventors: Thomas Freeman, Kennebunk, ME (US); Colin G. Amadon, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 227 days.

(21) Appl. No.: 15/409,677

(22) Filed: Jan. 19, 2017

(65) Prior Publication Data

US 2018/0202461 A1 Jul. 19, 2018

(51) Int. Cl.

| | |
|---|---|
| ***F01D 25/24*** | (2006.01) |
| ***F04D 29/54*** | (2006.01) |
| ***F04D 29/08*** | (2006.01) |
| ***F04D 29/66*** | (2006.01) |
| *F01D 11/00* | (2006.01) |

(52) U.S. Cl.

CPC ..... *F04D 29/542* (2013.01); *F01D 25/246* (2013.01); *F04D 29/083* (2013.01); *F04D 29/541* (2013.01); *F04D 29/668* (2013.01); *F01D 11/005* (2013.01)

(58) Field of Classification Search

CPC ..... F01D 5/246; F01D 5/26; F01D 11/005; F01D 9/042

See application file for complete search history.

(56) References Cited

U.S. PATENT DOCUMENTS

| | | | | |
|---|---|---|---|---|
| 8,899,914 | B2 * | 12/2014 | Ring | F01D 9/042 415/119 |
| 8,920,112 | B2 * | 12/2014 | Ring | F01D 25/04 415/119 |
| 9,353,649 | B2 * | 5/2016 | Rioux | F01D 25/246 |
| 2012/0128481 | A1 | 5/2012 | Baumas et al. | |
| 2014/0241874 | A1 | 8/2014 | Rioux | |

FOREIGN PATENT DOCUMENTS

| | | |
|---|---|---|
| EP | 0974734 A2 | 1/2000 |
| EP | 2612998 A2 | 7/2013 |

OTHER PUBLICATIONS

Extended European Search Report for EP Application No. 18152123.8, dated Sep. 6, 2018, 13 pages.

* cited by examiner

*Primary Examiner* — Justin D Seabe
*Assistant Examiner* — Sabbir Hasan
(74) *Attorney, Agent, or Firm* — Kinney & Lange, P.A.

(57) ABSTRACT

A liner assembly for placement between a mounting foot of a platform and a case of a gas turbine engine includes first and second annular liner segments configured to move independently of each other. The first annular liner segment is configured to be mounted on at least a portion of a radially outward surface of the mounting foot. The first annular liner segment includes a first flat portion and a first curved portion extending from a first end of the first annular liner segment. The second annular liner segment is configured to be mounted on at least a portion of a radially inward surface of the mounting foot. The second annular liner segment includes a second flat portion and a second curved portion extending from a first end of the second annular liner segment.

14 Claims, 6 Drawing Sheets

TWO-PIECE MULTI-SURFACE WEAR LINER

BACKGROUND

The operating environment for gas turbine engines is extremely harsh. Vibrations due to normal use at operating speeds are extreme. Additionally, the operating temperature experienced by some engine components is extremely high. The feet of vanes are among the many components that experience wear in the engine due to vibrations and high temperature. Wear liners are used between the vane feet and an engine case to reduce wear. However, current wear liner designs utilize a single piece design. Vane foot are installed circumferentially into the case one vane at a time, which makes it difficult to install the vanes with the wear liner.

The fit of the vane foot within the case typically includes a clearance fit accommodating relative thermal growth of the components during operation. The relative movement can cause wear as well as provide an undesired leak path across the wear liner.

SUMMARY

A liner assembly for placement between a mounting foot of a platform and a case of a gas turbine engine includes first and second annular liner segments configured to move independently of each other. The first annular liner segment is configured to be mounted on at least a portion of a radially outward surface of the mounting foot. The first annular liner segment includes a first flat portion and a first curved portion extending from a first end of the first annular liner segment. The second annular liner segment is configured to be mounted on at least a portion of a radially inward surface of the mounting foot. The second annular liner segment includes a second flat portion and a second curved portion extending from a first end of the second annular liner segment.

A gas turbine engine includes a case, a stator, and a liner assembly. The case includes a J-groove disposed in the case. The stator is mounted within the case and includes a vane, a platform, and a mounting foot. The platform is attached to a radially outward end of the vane. The mounting foot is mounted within the J-groove and includes a radially outward surface, a radially inward surface, and a first end. The liner assembly includes first and second annular liner segments configured to move independently of each other. The first annular liner segment is mounted on at least a portion of the radially outward surface of the mounting foot. The second annular liner segment is mounted on at least a portion of the radially inward surface of the mounting foot.

A method of assembling a vane and a liner assembly in a gas turbine engine includes inserting first and second annular liner segments of the liner assembly into a J-groove in a case of the gas turbine engine so as to mount the first and second annular liner segments into the case. A mounting foot of the vane is inserted between the first and second annular liner segments so as to mount the foot of the vane into the J-groove of the case.

DETAILED DESCRIPTION

The present application discloses a wear liner assembly including a two-piece configuration. The two-piece wear liner protects both the ID and OD surfaces of a case J-groove. The two-piece design also eliminates stacking of tolerances among the liners and the foot, thereby allowing the stator to have a tighter fit into the case. The split between the two-pieces of the wear liner allow both pieces to move independently, which makes circumferential stator installation into the case J-groove easier.

Figure 1:
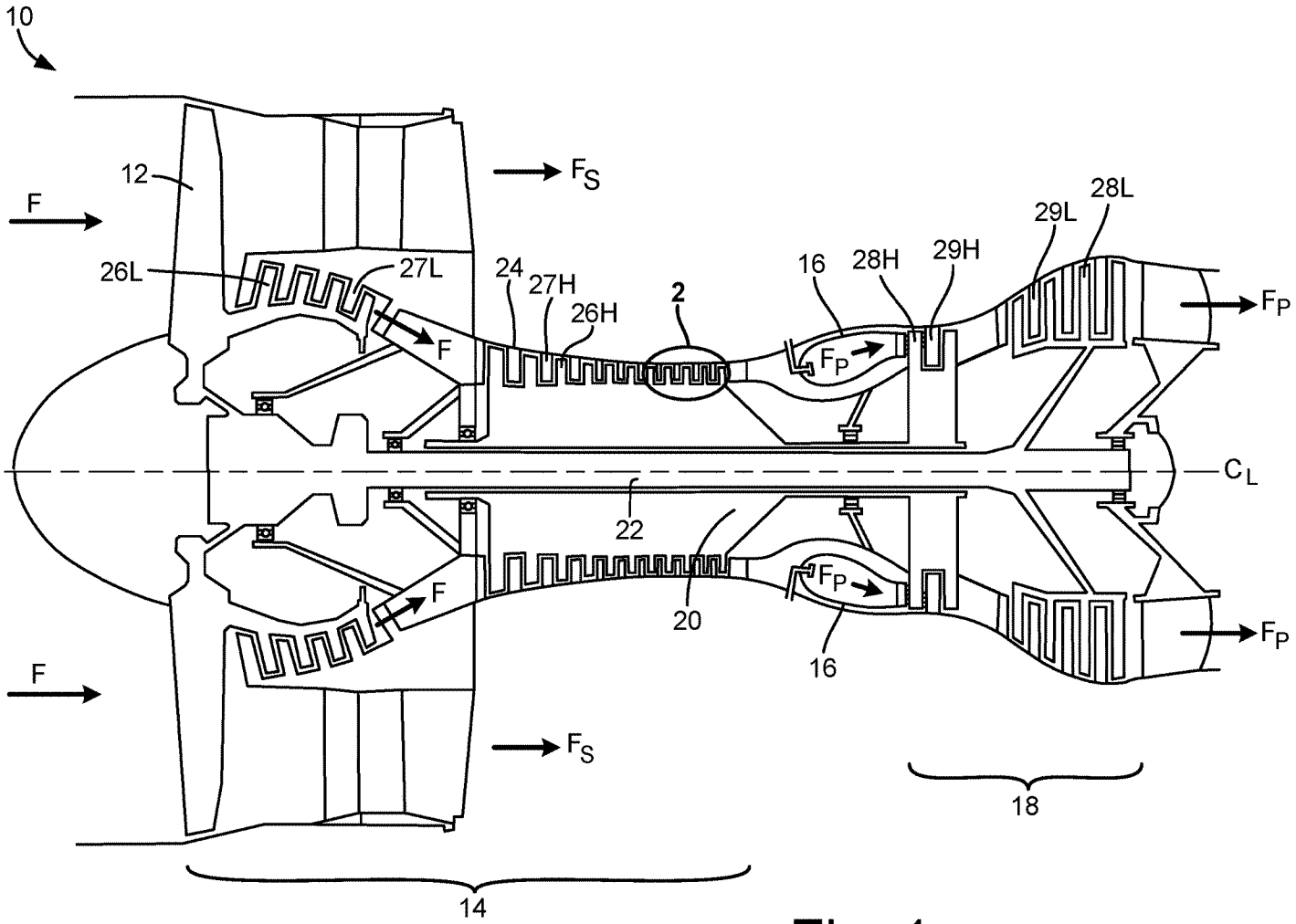
FIG. 1 is a cross-section view of a gas turbine engine.

FIG. 1 is a cross-section view of gas turbine engine 10 including a liner/vane assembly of the present invention. The view in FIG. 1 is a longitudinal sectional view along engine centerline $C_L$. FIG. 1 shows gas turbine engine 10 including fan blade 12, compressor 14, combustor 16, turbine 18, high-pressure rotor 20, low-pressure rotor 22, and engine case 24. Compressor 14 includes low-pressure rotor stages 26L, high-pressure rotor stages 26H, low-pressure stator stages 27L, and high-pressure stator stages 27H. Turbine 18 includes high-pressure rotor stages 28H, low-pressure rotor stages 28L, high-pressure stator stages 29H, and low-pressure stator stages 29L.

As illustrated in FIG. 1, fan blade 12 extends from engine centerline $C_L$ near a forward end of gas turbine engine 10. Compressor 14 is disposed aft of fan blade 12 along engine centerline $C_L$, followed by combustor 16. Turbine 18 is located adjacent combustor 16, opposite compressor 14. High-pressure rotor 20 and low-pressure rotor 22 are mounted for rotation about engine centerline $C_L$. High-pressure rotor 20 connects a high-pressure section of turbine 18 to a high-pressure section of compressor 14. Low-pressure rotor 22 connects a low-pressure section of turbine 18 to fan blade 12 and a low-pressure section of compressor 14. Rotor stages 26 and stator stages 28 are arranged throughout compressor 14 and turbine 18 in alternating rows. High-pressure rotor stages 26H and 28H connect to high-pressure rotor 20 and low-pressure rotor stages 26L and 28L connect to low-pressure rotor 22. Engine case 24 surrounds turbine engine 10 providing structural support for compressor 14, combustor 16, and turbine 18, as well as containment for air flow through engine 10.

In operation, air flow F enters compressor 14 after passing between fan blades 12. Air flow F is compressed by the rotation of compressor 14 driven by high-pressure turbine 18. The compressed air from compressor 14 is divided, with a portion going to combustor 16, a portion bypasses through fan 12, and a portion employed for cooling components, buffering, and other purposes. Compressed air and fuel are mixed and ignited in combustor 16 to produce high-temperature, high-pressure combustion gases $F_P$. Combustion gases $F_P$ exit combustor 16 into turbine section 18.

Stator stages 27L, 27H, 29H, and 29L properly align the flow of air flow F and combustion gases $F_P$ for an efficient attack angle on subsequent rotor stages 26L, 26H, 28H, and 28L respectively. The flow of combustion gases $F_P$ past low pressure rotor stages 28L of turbine section 18 drives rotation of low-pressure rotor 22 (which drives fan blades 12 to produce thrust $F_S$ from gas turbine engine 10) and low-pressure compressor stages 26L. High pressure rotor stages 28H of turbine section drive high-pressure rotor 20, which drives high-pressure rotor stages 26H of compressor 14.

Although embodiments of the present invention are illustrated for a turbofan gas turbine engine for aviation use, it is understood that the present invention applies to other aviation gas turbine engines and to industrial gas turbine engines as well.

Figure 2:
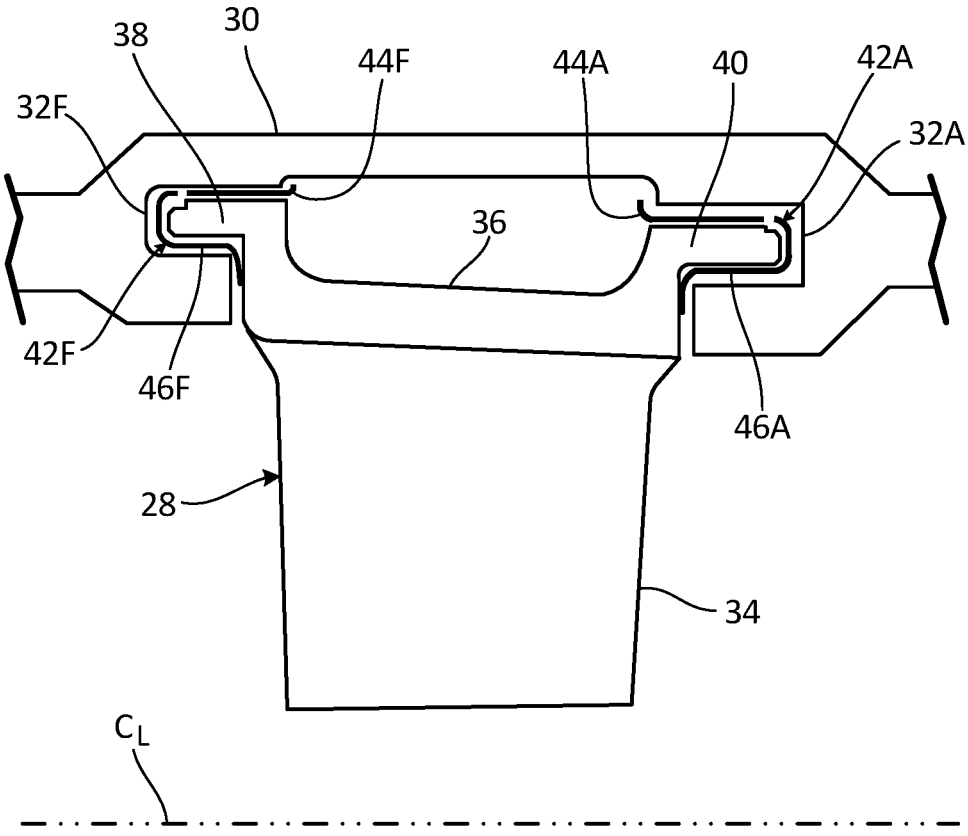
FIG. 2 is a cross-section view of a compressor case of the gas turbine engine with a stator stage.

FIG. 2 shows stator stage 28, compressor case 30 with forward J-groove 32F and aft J-groove 32A, vane 34, platform 36 with forward foot 38 and aft foot 40, forward liner assembly 42F with first annular liner segment 44F and second annular liner segment 46F, and aft liner assembly 42A with first annular liner segment 44A and second annular liner segment 46A. Although detailed discussion of aft foot 40 and aft liner assembly 42A is included herein, it should be understood that a configuration of aft liner assembly 42A is applicable to a wide variety of locations throughout gas turbine engine 10 such as with forward liner assembly 42F with forward foot 38, as well as other locations such as low or high pressure sections of compressor section 14 or turbine section 18.

Compressor case 30 is a portion of engine case 24 that surrounds compressor 14. Stator stage 28 is a circumferential array of a plurality of vanes 34. Vane 34 is a cantilevered vane which extends radially inward from platform 36 toward centerline axis $C_L$. In other non-limiting embodiments, vanes 34 may be supported from both inner and outer radial ends (with respect to centerline axis $C_L$) and vanes 34 may be disposed in other sections of gas turbine engine 10 such as turbine 18 (FIG. 1). Platform 36 is a radially outer platform of stator stage 28. Forward foot 38 is an engagement feature located on an upstream end of platform 36 (upstream direction shown as right to left in FIGS. 1-4). Aft foot 40 is an engagement feature located on a downstream end of platform 36 (downstream direction shown as left to right in FIGS. 1-4). Aft foot 40 and forward foot 38 are disposed on opposing ends of platform 36.

Liner assembly 42A is a two-piece wear liner and includes first annular liner segment 44A and second annular liner segment 46A. First annular liner segment 44A and second annular liner segment 46A are single wear liner pieces. In one non-limiting embodiment, first annular liner segment 44A and second annular liner segment 46A are full-hoop, but can also extend less than full-hoop.

As will be discussed subsequently, platform 36 is adapted with forward foot 38 and aft foot 40 that are disposed within compressor case 30 to allow vanes 34 to be supported therefrom. First and second annular liner segments 44A and 46A are disposed between compressor case 30 and platform 36. First and second annular liner segments 44A and 46A dampen vibration between vane 34 and compressor case 30, accommodate thermal growth between platform 36 and compressor case 30, and allow for ease of assembly and disassembly of vane 34.

Figure 3A:
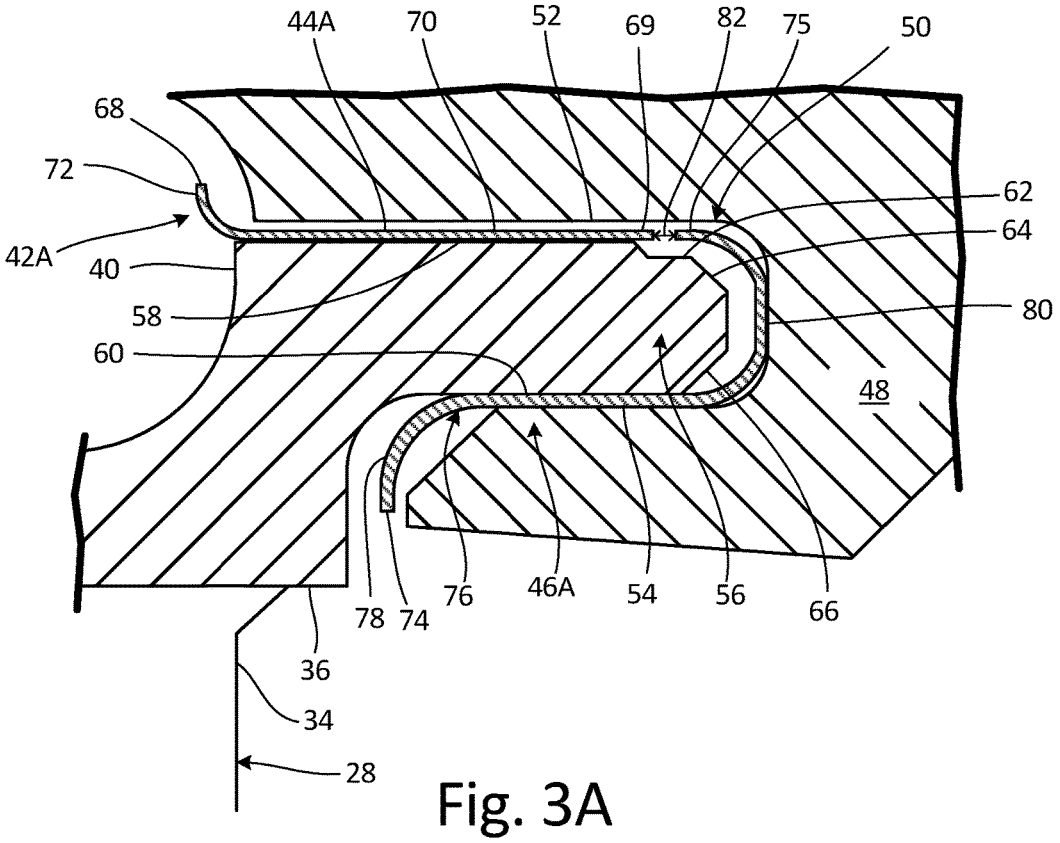
FIG. 3A is a cross-section view of the stator, the compressor case, and a first liner assembly.

FIG. 3A shows a cross-section view of stator stage 28 including vane 34 and platform 36, compressor case 30 with J-groove 32A (including first surface 52 and second surface 54), aft foot 40 (including first end 56, radially outward surface 58, radially inward surface 60, undercut 62, outer chamfer 64, and inner chamfer 66), liner assembly 42A with first annular liner segment 44A (including first end 68, second end 69, first flat portion 70, and first curved portion 72) and second annular liner segment 46A (including first end 74, second end 75, second flat portion 76, second curved portion 78, and second hook portion 80), and split 82.

Compressor case 30 is a portion of engine case 24 extending circumferentially about compressor 14 of gas turbine engine 10. J-groove 32A is a slot or groove extending circumferentially within compressor case 30. Stator stage 28 is a stator vane of gas turbine engine 10 that includes vane 34 and platform 36. Vane 34 is a blade or airfoil. Platform 36 is an end of stator stage 28 configured for attachment to a case such as compressor case 30.

Liner assembly 42A is a two-piece wear liner including first annular liner segment 44A and second annular liner segment 46A. First annular liner segment 44A and second annular liner segment 46A may comprise any material including characteristics which are desired and/or critical for the specific implementation of liner assembly 42A such as metal, ceramic, mineral, plastic, or any other suitable abrasion resistant material. First end 68 and second end 69 are ends of first annular liner segment 44A. First flat portion 70 is a portion of first annular liner segment 44A that maintains a constant diameter along a length of first flat portion 70. First curved portion 72 is a curved portion of first annular liner segment 44A that increases in diameter along an axially upstream direction (right to left in FIGS. 3A-3C). First end 74 and second end 75 are ends of second annular liner segment 46A. Second flat portion 76 is a portion of second annular liner segment 46A that maintains a constant diameter along a length of second flat portion 76. Second curved portion 78 is a curved portion of second annular liner segment 46A that decreases in diameter along an axially upstream direction (right to left in FIGS. 3A-3C). Second hook portion 80 is a curved portion of second annular liner segment 46A that forms a hook shape.

Split 82 is a space extending between second end 69 of first annular liner segment 44A and second end 75 of second annular liner segment 46A. In one non-limiting embodiment, split 82 can include a distance greater than or equal to zero inches. In another non-limiting embodiment, split 82 can be configured such that second end 69 of first annular liner segment 44A and second end 75 of second annular liner segment 46A can overlap each other.

Aft foot 40 is a hook or mounting feature located along a first end of platform 36. First end 56 is a downstream end of aft foot 40 (with a downstream direction from left to right in FIGS. 3A-3C). Radially outward surface 58 is a surface located along a radially outer edge of aft foot 40. Radially inner surface 60 is a surface located along a radially inner edge of aft foot 40. Undercut 62 is a cutout taken from first end 56 of aft foot 40. Outer chamfer 64 is an angled cut taken from first end 56 of aft foot 40. Inner chamfer 66 is another angle cut taken from first end 56 of aft foot 40.

Compressor case 30 is a portion of engine case 24 that extends axially along compressor 14 of gas turbine engine 10. J-groove 32A extends into compressor case 30 to create an annular slot for receiving liner assembly 42A and aft foot 40. Stator stage 28 is attached to compressor case 30 via aft foot 40 engaging with J-groove 32A of compressor case 30. Vane 34 can be attached to or formed as a single piece with platform 36. Platform 36 is attached to compressor case through engagement of aft foot 40 with J-groove 32A of compressor case 30.

Liner assembly 42A is disposed between aft foot 40 and compressor case 30. Liner assembly 42A with first annular liner segment 44A and second annular liner segment 46A extends in a circumferential direction about centerline axis $C_L$ of gas turbine engine 10 (FIG. 1). First annular liner segment 44A is configured to be mounted on at least a portion of radially outward surface 58 of the aft foot 40. Second annular liner segment 46A is configured to be mounted on at least a portion of radially inward surface 60 of the aft foot 40. First annular liner segment 44A and second annular liner segment 46A are configured to receive aft foot 40 of platform 36. First annular liner segment 44A and second annular liner segment 46A are also configured to move independently of each other. A portion of first annular liner segment 44A is disposed between radially outward surface 58 of aft foot 40 and compressor case 30. A portion of second annular liner segment 46A is disposed between radially inward surface 60 of aft foot 40 and compressor case 30. First curved portion 72 is disposed upstream of first flat portion 70 relative to an orientation of stator stage 28 in gas turbine engine 10. Second curved portion 78 is disposed upstream of second flat portion 76. Second hook portion 80 extends or hooks around first end 56 of aft foot 40.

Split 82 extends between second end 69 of first annular liner segment 44A and second end 75 of second annular liner segment 46A. In FIG. 3A, split 82 is disposed along outer chamfer 64 of aft foot 40. Second hook portion 80 extends around first end 56 of aft foot 40 such that second end 74 of second annular liner segment 46A is disposed radially outward from first end 56 of aft foot 40. Aft foot 40 is disposed in J-groove 32A of compressor case 30 in between first annular liner segment 44A and second annular liner segment 46A.

Undercut 62 is disposed along radially outward surface 58 of aft foot 40 at first end 56. Outer chamfer 64 is disposed at an intersection of radially outward surface 58 of aft foot 40 and first end 56. Inner chamfer 66 is disposed at an intersection of radially inward surface 60 of aft foot 40 and first end 56.

During assembly of compressor case 30, first and second annular liner segments 44A and 46A of liner assembly 42A are inserted into J-groove 32A so as to mount first and second annular liner segments 44A and 46A into compressor case 30. First annular liner segment 44A and second annular liner segment 46A fit into J-groove 32A such that first annular liner segment 44A and second annular liner segment 46A maintain a tight fit with compressor case 30. After first annular liner segment 44A and second annular liner segment 46A are inserted into J-groove 32A of compressor case 30, aft foot 40 of stator stage 28 is circumferentially inserted and installed into J-groove 32A. For example, aft foot 40 of platform 36 is inserted into J-groove 32A of compressor case 30 along a circumferential direction of compressor case 30.

As aft foot 40 is installed between first annular liner segment 44A and second annular liner segment 46A in J-groove 32A, first annular liner segment 44A and second annular liner segment 46A are able to move independently from each other allowing relative radial motion between first annular liner segment 44A and second annular liner segment 46A. As aft foot 40 is inserted into J-groove 32A, first annular liner segment 44A is pressed against radially outward surface 58 of aft foot 40 and against first surface 52 of J-groove 32A and second annular liner segment 46A is pressed against radially inward surface 60 of aft foot 40 and against second surface 54 of J-groove 32A.

Liner assembly 42A with first annular liner segment 44A and second annular liner segment 46A forms a wear liner to protect aft foot 40 and surfaces of J-groove 32A within compressor case 30 from abrasion and wear caused during installation and operation of gas turbine engine 10. Split 82 enables first annular liner segment 44A and second annular liner segment 46A to move independently from each other. The location of split 82 in FIG. 3A is shown as disposed along a radially outward portion of J-groove 32A. In this non-limiting embodiment, a radially inward side of aft foot 40 is loaded more than a radially outward side of aft foot 40. In other non-limiting embodiments (see FIGS. 3B and 3C), split 82 can be disposed at other radial and axial locations along aft foot 40 depending on where and how aft foot 40 is loaded.

The relative radial motion between first annular liner segment 44A and second annular liner segment 46A allows for smaller tolerances and a tighter fit between aft foot 40, first annular liner segment 44A, second annular liner segment 46A, and compressor case 30 than a single-piece liner configuration would have. Liner assembly 42A allows each of first annular liner segment 44A and second annular liner segment 46A to account for their own tolerances instead of having to account for the stacking of tolerances with a single-piece liner configuration. This allows for more freedom of motion between first annular liner segment 44A and second annular liner segment 46A during assembly which allows for easier circumferential assembly of stator stages 28 in compressor case 30.

Figure 3B:
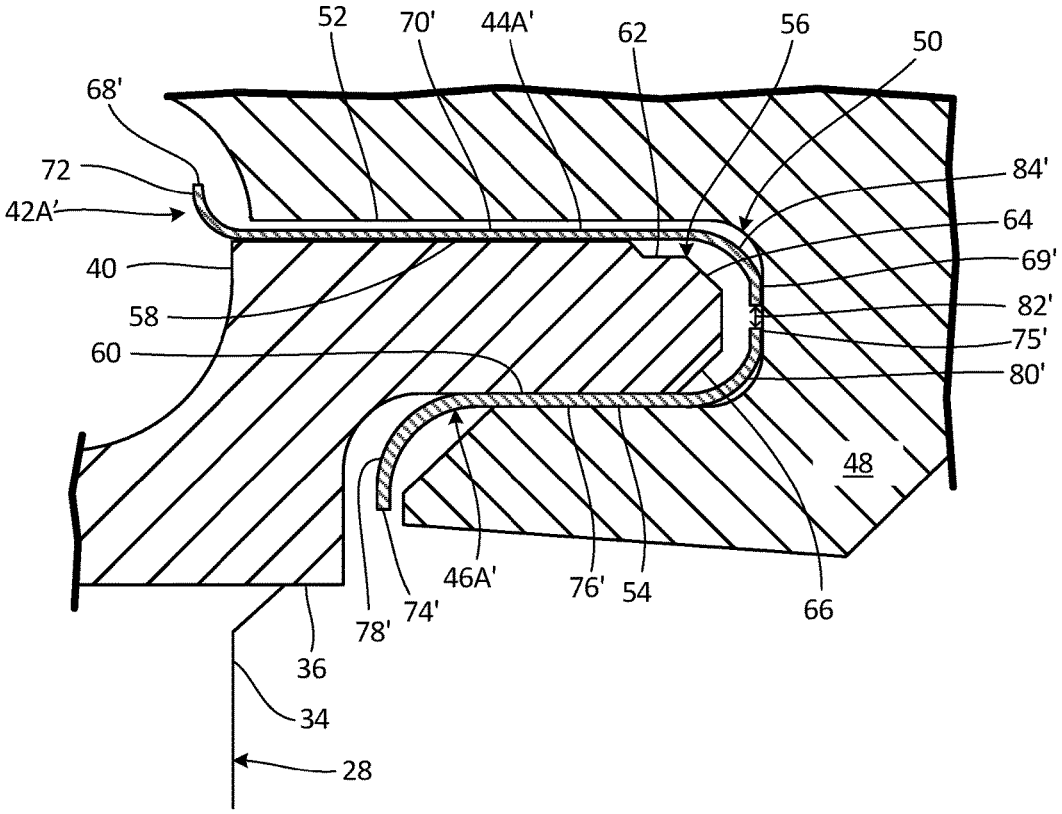
FIG. 3B is a cross-section view of the stator, the compressor case, and a second liner assembly.

FIG. 3B shows a cross-section view of compressor case 30 including J-groove 32A, stator stage 28 including vane 34 and platform 36, aft foot 40 (including first end 56, radially outward surface 58, radially inward surface 60, undercut 62, outer chamfer 64, and inner chamfer 66), liner assembly 42A' including first annular liner segment 44A' (including first end 68', second end 69', first flat portion 70', first curved portion 72', and first hook portion 84') and second annular liner segment 46A' (including first end 74', second end 75', second flat portion 76', second curved portion 78', and second hook portion 80'), and split 82'.

Liner assembly 42A' is a two-piece wear liner including first annular liner segment 44A' and second annular liner segment 46A'. First annular liner segment 44A' and second annular liner segment 46A' may comprise any material including characteristics which are desired and/or critical for the specific implementation of liner assembly 42A' such as metal, ceramic, mineral, plastic, or any other suitable abrasion resistant material. First end 68' and second end 69' are ends of first annular liner segment first 40'. First flat portion 70' is a portion of first annular liner segment 44A' that maintains a constant diameter along a length of first flat portion 70'. First curved portion 72' is a curved portion of first annular liner segment 44A' that increases in diameter along an axially upstream direction (right to left in FIGS. 3A-3C). First hook portion 84' is a curved portion of first annular liner segment 44A that forms a hook shape. First end 74' and second end 75' are ends of second annular liner segment 46A'. Second flat portion 76' is a portion of second annular liner segment 46A' that maintains a constant diameter along a length of second flat portion 76'. Second curved portion 78' is a curved portion of second annular liner segment 46A' that decreases in diameter along an axially upstream direction (right to left in FIGS. 3A-3C). Second hook portion 80' is a curved portion of second annular liner segment 46A' that forms a hook shape.

Split 82' is a space extending between second end 69' of first annular liner segment 44A' and second end 75' of second annular liner segment 46A'. In one non-limiting embodiment, split 82' can include a distance greater than or equal to zero inches. In another non-limiting embodiment, split 82' can be configured such that second end 69' of first annular liner segment 44A' and second end 75' of second annular liner segment 46A' can overlap each other.

Liner assembly 42A' is disposed between aft foot 40 and compressor case 30. Liner assembly 42A' with first annular liner segment 44A' and second annular liner segment 46A' extends in a circumferential direction about centerline axis $C_L$ of gas turbine engine 10 (FIG. 1). First annular liner segment 44A' is configured to be mounted on at least a portion of radially outward surface 58 of the aft foot 40. Second annular liner segment 46A' is configured to be mounted on at least a portion of radially inward surface 60 of the aft foot 40. First annular liner segment 44A' and second annular liner segment 46A' are configured to receive aft foot 40 of vane 34. First annular liner segment 44A' and second annular liner segment 46A' are also configured to move independently of each other. A portion of first annular liner segment 44A' is disposed between radially outward surface 58 of aft foot 40 and compressor case 30. A portion of second annular liner segment 46A' is disposed between radially inward surface 60 of aft foot 40 and compressor case 30. First curved portion 72' is disposed upstream of first flat portion 70' relative to an orientation of stator stage 28 in gas turbine engine 10. First hook portion 84' extends or hooks around a radially outward portion of first end 56 of aft foot 40. Second curved portion 78' is disposed upstream of second flat portion 76'. Second hook portion 80' extends or hooks around a radially inward portion of first end 56 of aft foot 40.

Split 82' extends between second end 69' of first annular liner segment 44A' and second end 75' of second annular liner segment 46A'. In FIG. 3B, split 82' is disposed radially in-between outward surface 58 and radially inward surface 60 of aft foot 40. Second hook portion 80' extends around first end 56 of aft foot 40 such that second end 75' of second annular liner segment 46A' is disposed radially in-between between outward surface 58 and radially inward surface 60 of aft foot 40. First hook portion 84' extends around first end 56 of aft foot 40 such that second end 69' of first annular liner segment 44A is disposed radially in-between between outward surface 58 and radially inward surface 60 of aft foot 40. Aft foot 40 is disposed in J-groove 32A of compressor case 30 in between first annular liner segment 44A' and second annular liner segment 46A'.

Undercut 62 is disposed along radially outward surface 58 of aft foot 40 at first end 56. Outer chamfer 64 is disposed at an intersection of radially outward surface 58 of aft foot 40 and first end 56. Inner chamfer 66 is disposed at an intersection of radially inward surface 60 of aft foot 40 and first end 56.

During assembly of compressor case 30, liner assembly 42A' is inserted into J-groove 32A. First annular liner segment 44A' and second annular liner segment 46A' fit into J-groove 32A such that first annular liner segment 44A' and second annular liner segment 46A' maintain a tight fit with compressor case 30. After first annular liner segment 44A' and second annular liner segment 46A' are inserted into J-groove 32A of compressor case 30, aft foot 40 of stator stage 28 is circumferentially inserted and installed into J-groove 32A. For example, aft foot 40 of platform 36 is inserted into J-groove 32A of compressor case 30 along a circumferential direction of compressor case 30. As aft foot 40 is installed between first annular liner segment 44A' and second annular liner segment 46A' in J-groove 32A, first annular liner segment 44A' and second annular liner segment 46A' are able to move independently from each other allowing relative radial motion between first annular liner segment 44A' and second annular liner segment 46A'.

Liner assembly 42A' with first annular liner segment 44A' and second annular liner segment 46A' forms a wear liner to protect aft foot 40 and surfaces of J-groove 32A within compressor case 30 from abrasion and wear caused during installation and operation of gas turbine engine 10. Split 82' enables first annular liner segment 44A' and second annular liner segment 46A' to move independently from each other.

The location of split 82' in FIG. 3B is shown as disposed along a radial mid-point of J-groove 32A. In this non-limiting embodiment, the radially inward side of aft foot 40 is loaded about the same as the radially outward side of aft foot 40. In other non-limiting embodiments (see FIGS. 3A and 3C), split 82' can be disposed at other radial and axial locations along aft foot 40 depending on where and how aft foot 40 is loaded.

Figure 3C:
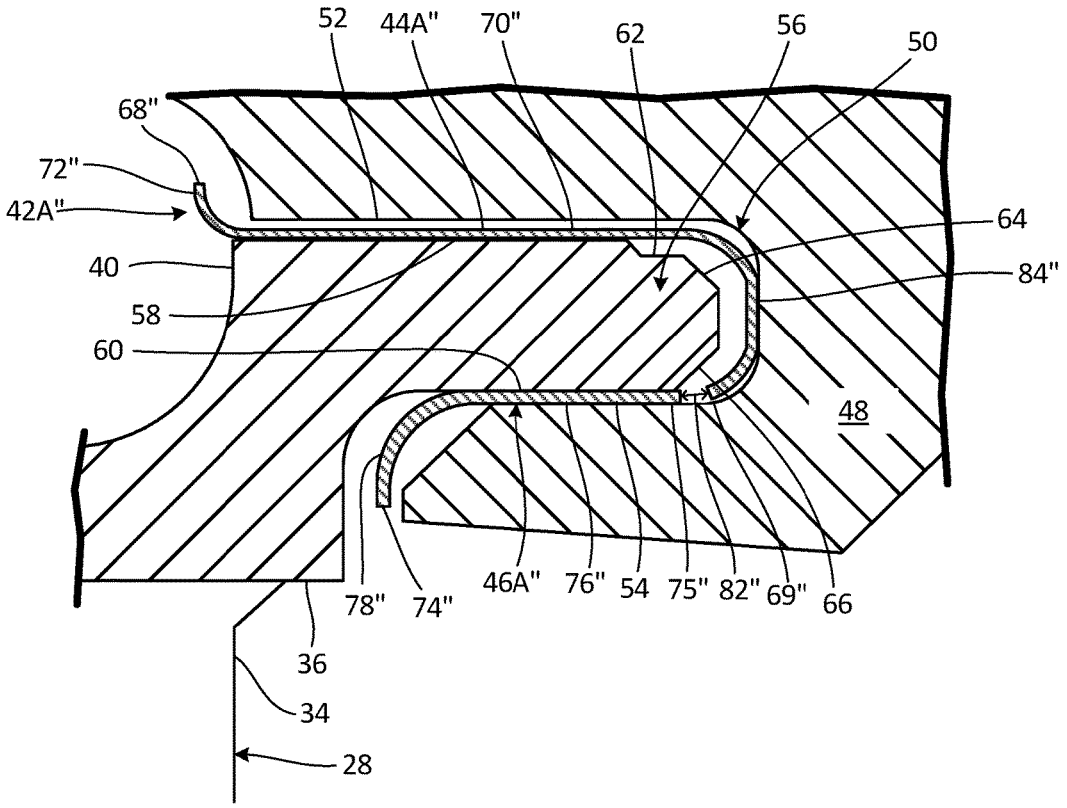
FIG. 3C is a cross-section view of the stator, the compressor case, and a third liner assembly.

FIG. 3C shows a cross-section view of compressor case 30 including J-groove 32A, stator stage 28 including vane 34 and platform 36, aft foot 40 (including first end 56, radially outward surface 58, radially inward surface 60, undercut 62, outer chamfer 64, and inner chamfer 66), liner assembly 42A" including first annular liner segment 44A" (including first end 68", second end 69", first flat portion 70", first curved portion 72", and first hook portion 84") and second annular liner segment 46A" (including first end 74", second end 75", second flat portion 76", second curved portion 78", and second hook portion 80"), and split 82".

Liner assembly 42A" is a two-piece wear liner including first annular liner segment 44A" and second annular liner segment 46A". First annular liner segment 44A" and second annular liner segment 46A" may comprise any material including characteristics which are desired and/or critical for the specific implementation of liner assembly 42A" such as metal, ceramic, mineral, plastic, or any other suitable abrasion resistant material. First end 68" and second end 69" are ends of first annular liner segment first 40". First flat portion 70" is a portion of first annular liner segment 44A" that maintains a constant diameter along a length of first flat portion 70". First curved portion 72" is a curved portion of first annular liner segment 44A" that increases in diameter along an axially upstream direction (right to left in FIGS. 3A-3C). First hook portion 84" is a curved portion of first annular liner segment 44A that forms a hook shape. First end 74" and second end 75" are an ends of second annular liner segment 46A". Second flat portion 76" is a portion of second annular liner segment 46A" that maintains a constant diameter along a length of second flat portion 76". Second curved portion 78" is a curved portion of second annular liner segment 46A" that decreases in diameter along an axially upstream direction (right to left in FIGS. 3A-3C).

Split 82" is a space extending between second end 69" of first annular liner segment 44A" and second end 75" of second annular liner segment 46A". In one non-limiting embodiment, split 82" can include a distance greater than or equal to zero inches. In another non-limiting embodiment, split 82" can be configured such that second end 69" of first annular liner segment 44A" and second end 75" of second annular liner segment 46A" can overlap each other.

Liner assembly 42A" is disposed between aft foot 40 and compressor case 30. Liner assembly 42A" with first annular liner segment 44A" and second annular liner segment 46A" extends in a circumferential direction about centerline axis $C_L$ of gas turbine engine 10 (FIG. 1). First annular liner segment 44A" is configured to be mounted on at least a portion of radially outward surface 58 of the aft foot 40. Second annular liner segment 46A" is configured to be mounted on at least a portion of radially inward surface 60 of the aft foot 40. First annular liner segment 44A" and second annular liner segment 46A" are configured to receive aft foot 40 of vane 34. First annular liner segment 44A" and second annular liner segment 46A" are also configured to move independently of each other. A portion of first annular liner segment 44A" is disposed between radially outward surface 58 of aft foot 40 and compressor case 30. A portion of second annular liner segment 46A" is disposed between radially inward surface 60 of aft foot 40 and compressor case 30. First curved portion 72" is disposed upstream of first flat portion 70" relative to an orientation of stator stage 28 in gas turbine engine 10. First hook portion 84" extends or hooks around first end 56 of aft foot 40. Second curved portion 78" is disposed upstream of second flat portion 76".

Split 82" extends between second end 69" of first annular liner segment 44A" and second end 75" of second annular liner segment 46A". In FIG. 3C, split 82 is disposed along inner chamfer 66 of aft foot 40. First hook portion 84" extends around first end 56 of aft foot 40 such that second end 69" of first annular liner segment 44A" is disposed radially inward from first end 56. Aft foot 40 is disposed in J-groove 32A of compressor case 30 in between first annular liner segment 44A" and second annular liner segment 46A".

Undercut 62 is disposed along radially outward surface 58 of aft foot 40 at first end 56. Outer chamfer 64 is disposed at an intersection of radially outward surface 58 of aft foot 40 and first end 56. Inner chamfer 66 is disposed at an intersection of radially inward surface 60 of aft foot 40 and first end 56.

During assembly of compressor case 30, liner assembly 42A" is inserted into J-groove 32A. First annular liner segment 44A" and second annular liner segment 46A" fit into J-groove 32A such that first annular liner segment 44A" and second annular liner segment 46A" maintain a tight fit with compressor case 30. After first annular liner segment 44A" and second annular liner segment 46A" are inserted into J-groove 32A of compressor case 30, aft foot 40 of stator stage 28 is circumferentially inserted and installed into J-groove 32A. For example, aft foot 40 of platform 36 is inserted into J-groove 32A of compressor case 30 along a circumferential direction of compressor case 30. As aft foot 40 is installed between first annular liner segment 44A" and second annular liner segment 46A" in J-groove 32A, first annular liner segment 44A" and second annular liner segment 46A" are able to move independently from each other allowing relative radial motion between first annular liner segment 44A" and second annular liner segment 46A".

Liner assembly 42A" with first annular liner segment 44A" and second annular liner segment 46A" forms a wear liner to protect aft foot 40 and surfaces of J-groove 32A within compressor case 30 from abrasion and wear caused during installation and operation of gas turbine engine 10. Split 82" enables first annular liner segment 44A" and second annular liner segment 46A" to move independently from each other.

The location of split 82" in FIG. 3C is shown as disposed along a radially inward portion of J-groove 32A. In this non-limiting embodiment, a radially outward side of aft foot 40 is loaded more than a radially inward side of aft foot 40. In other non-limiting embodiments (see FIGS. 3A and 3C), split 82" can be disposed at other radial and axial locations along aft foot 40 depending on where and how aft foot 40 is loaded.

Figure 4:
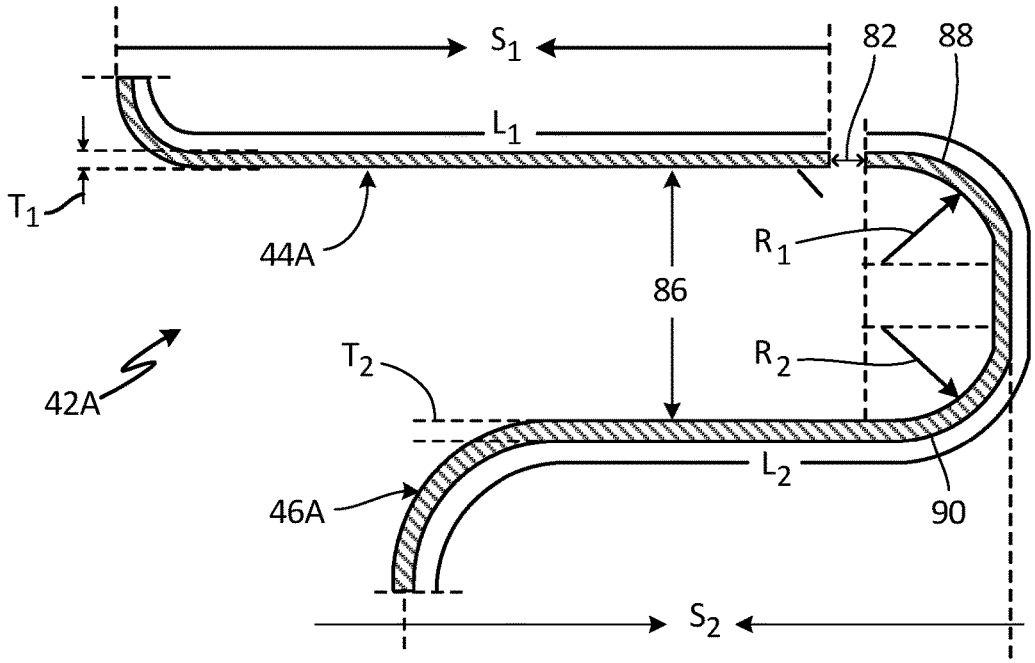
FIG. 4 is a cross-section view of the first liner assembly.

FIG. 4 shows a cross-section view of liner assembly 42A with first annular liner segment 44A, second annular liner segment 46A, and channel 86 extending between first annular liner segment 44A and second annular liner segment 46A. First annular liner segment 44A includes first thickness $T_1$, first length $L_1$, and first axial span $S_1$. Second annular liner segment 46A includes second thickness $T_2$, second length $L_2$, and second axial span $S_2$. Second hook portion 78 of second annular liner segment 46A includes first corner 88 with first radius of curvature $R_1$ and second corner 90 with second radius of curvature $R_2$.

Channel 86 is a space or gap along a radial direction between first annular liner segment 44A and second annular liner segment 46A. In one non-limiting embodiment, a distance of channel 86 is approximately twelve times larger than second thickness $T_2$ of second annular liner segment 46A, such as is shown in FIG. 4. In general, the distance of channel 86 is greater than zero and is configured to match or be slightly greater than a radial width of aft foot 40.

First and second thickness $T_1$ and $T_2$ can range from 0.001 to 0.025 inches (0.048 to 0.762 millimeters). In one non-limiting embodiment, first and second thickness $T_1$ and $T_2$ are equal. In another non-limiting embodiment, first and second thickness $T_1$ and $T_2$ are not equal. In other non-limiting embodiments, first and second thicknesses $T_1$ and $T_2$ can vary based upon a localized need for wear resistance along aft foot 40.

First length $L_1$ is a length of first annular liner segment 44A taken from end to end. Second length $L_2$ is a length of second annular liner segment 46A taken from end to end. In FIGS. 3A and 4, first length $L_1$ is smaller than second length $L_2$ of second annular liner segment 46A. In other non-limiting embodiments, first length $L_1$ can be equal to or greater than second length $L_2$ (see FIGS. 3B and 3C).

First axial span $S_1$ of first annular liner segment 44A is a distance along an axial direction that first annular liner segment 44A spans. Second axial span $S_2$ of second annular liner segment 46A is a distance along an axial direction that second annular liner segment 46A spans. In FIGS. 3A and 4, first axial span $S_1$ is greater than second axial span $S_2$. In other non-limiting embodiments, first axial span $S_1$ can be equal to or less than second axial span $S_2$.

First radius of curvature $R_1$ is a radius of curvature of first corner 88 of second annular liner segment 46A. Second radius of curvature $R_2$ is a radius of curvature of second corner 90 of second annular liner segment 46A. First radius of curvature $R_1$ and second radius of curvature $R_2$ are shown as being approximately five times greater than second thickness $T_2$ of second annular liner segment 46A and less than half of the distance of channel 86. In other non-limiting embodiments, first radius of curvature $R_1$ and/or second radius of curvature $R_2$ can be different thicknesses than each other, greater or less than five times greater than second thickness $T_2$ of second annular liner segment 46A, and greater than or equal to half of the distance of channel 86. In another non-limiting embodiment, first radius of curvature $R_1$ and second radius of curvature $R_2$ are approximately equal. In other non-limiting embodiments, first radius of curvature $R_1$ can be less than or greater than second radius of curvature $R_2$. First radius of curvature $R_1$ and second radius of curvature $R_2$ are configured to match the curvatures of corresponding corners of J-groove 32A in compressor case 30.

The above description of second annular liner segment also extends to the corresponding elements of first annular liner segment 46A as shown in FIGS. 3B and 3C (such as first hook portion 84).

Discussion of Possible Embodiments

The following are non-exclusive descriptions of possible embodiments of the present invention.

A liner assembly for placement between a mounting foot of a platform and a case of a gas turbine engine includes first and second annular liner segments configured to move independently of each other. The first annular liner segment is configured to be mounted on at least a portion of a radially outward surface of the mounting foot. The first annular liner segment includes a first flat portion and a first curved portion extending from a first end of the first annular liner segment. The second annular liner segment is configured to be mounted on at least a portion of a radially inward surface of the mounting foot. The second annular liner segment includes a second flat portion and a second curved portion extending from a first end of the second annular liner segment.

The assembly of the preceding paragraph can optionally include, additionally and/or alternatively, any one or more of the following features, configurations and/or additional components.

The first and second annular liner segments can be configured to receive the mounting foot of the platform.

A split can be disposed between a second end of the first annular liner segment and a second end of the second annular liner segment.

The split can be disposed along the radially outward surface of the mounting foot, and further wherein the second annular liner segment can comprise a second hook portion extending around a first end of the mounting foot such that the second end of the second annular liner segment can be disposed radially outward from the first end of the mounting foot.

The split can be disposed along the radially inward surface of the mounting foot, and further wherein the first annular liner segment can comprise a first hook portion extending around a first end of the mounting foot such that the second end of the first annular liner segment can be disposed radially inward from the first end of the mounting foot.

The first annular liner segment can comprise a first hook portion extending around the first end of the mounting foot and the second annular liner segment can comprise a second hook portion extending around the first end of the mounting foot such that the split between the second end of the first annular liner segment and the second end of the second annular liner segment can be disposed radially in-between the radially outward and radially inward surfaces of the mounting foot.

A gas turbine engine includes a case, a stator, and a liner assembly. The case includes a J-groove disposed in the case. The stator is mounted within the case and includes a vane, a platform, and a mounting foot. The platform is attached to a radially outward end of the vane. The mounting foot is mounted within the J-groove and includes a radially outward surface, a radially inward surface, and a first end. The liner assembly includes first and second annular liner segments configured to move independently of each other. The first annular liner segment is mounted on at least a portion of the radially outward surface of the mounting foot. The second annular liner segment is mounted on at least a portion of the radially inward surface of the mounting foot.

The assembly of the preceding paragraph can optionally include, additionally and/or alternatively, any one or more of the following features, configurations and/or additional components.

The case can comprise a compressor case of the gas turbine engine.

The first and second annular liner segments can be configured to receive the mounting foot of the stator.

A split can be disposed between the first and second annular liner segments.

The split can be disposed along the radially outward surface of the mounting foot.

The split can be disposed along the radially inward surface of the mounting foot.

The split can be disposed along the first end of the mounting foot.

A method of assembling a vane and a liner assembly in a gas turbine engine includes inserting first and second annular liner segments of the liner assembly into a J-groove in a case of the gas turbine engine so as to mount the first and second annular liner segments into the case. A mounting foot of the vane is inserted between the first and second annular liner segments so as to mount the foot of the vane into the J-groove of the case.

The method of the preceding paragraph can optionally include, additionally and/or alternatively, any one or more of the following features, configurations and/or additional components.

The first annular liner segment can be pressed against a radially outward surface of the mounting foot and against a first surface of the J-groove; and the second annular liner segment can be pressed against a radially inward surface of the mounting foot and against a second surface of the J-groove.

The first and second annular liner segments can be configured to move independently of each other.

The mounting foot can be circumferentially installed into the J-groove.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A liner assembly for placement between a mounting foot of a platform and a case of a gas turbine engine, the liner assembly comprising:

a first annular liner segment configured to be mounted on at least a portion of a radially outward surface of the mounting foot, the first annular liner segment comprising: a first flat portion; and a first curved portion extending from a first end of the first annular liner segment;

a second annular liner segment configured to be mounted on at least a portion of a radially inward surface of the mounting foot, wherein the first annular liner segment and the second annular liner segment are configured to move independently of each other, further wherein the second annular liner segment comprises: a second flat portion; and a second curved portion extending from a first end of the second annular liner segment; and a second hook portion extending around a first end of the mounting foot such that a second end of the second annular liner segment is disposed radially outward from a first end of the mounting foot; and a split disposed between a second end of the first annular liner segment and a second end of the second annular liner segment, wherein the split is disposed along the radially outward surface of the mounting foot.

2. The liner assembly of claim 1, wherein the first annular liner segment and the second annular liner segment are configured to receive the mounting foot of the platform.

3. A gas turbine engine comprising:

a case with a J-groove disposed in the case, wherein the J-groove comprises an annular slot extending circumferentially within the case;

a stator mounted within the case, the stator comprising:

a vane;

a platform attached to a radially outward end of the vane;

a mounting foot mounted within the J-groove; the mounting foot including a radially outward surface, a radially inward surface, and a first end; and the liner assembly of claim 1.

4. The gas turbine engine of claim 3, wherein the case comprises a compressor case of the gas turbine engine.

5. The gas turbine engine of claim 3, wherein the first annular liner segment and the second annular liner segment are configured to receive the mounting foot of the stator.

6. A method of assembling a vane and a liner assembly in a gas turbine engine, the method comprising:

inserting a first annular liner segment and a second annular liner segment of the liner assembly into a J-groove in a case of the gas turbine engine so as to mount the first annular liner segment and the second annular liner segment into the case, wherein the J-groove comprises an annular slot extending circumferentially within the case, wherein the liner assembly comprises a split disposed between a second end of the first annular liner segment and a second end of the second annular liner segment, wherein the split is disposed along a radially outward surface of a mounting foot; and inserting the mounting foot of the vane between the first annular liner segment and the second annular liner segment so as to mount the foot of the vane into the J-groove of the cases wherein the second annular liner segment comprises a second hook portion extending around a first end of the mounting foot such that the second end of the second annular liner segment is disposed radially outward from the first end of the mounting foot.

7. The method of claim 6 further comprising:

pressing the first annular liner segment against a radially outward surface of the mounting foot and against a first surface of the J-groove; and pressing the second annular liner segment against a radially inward surface of the mounting foot and against a second surface of the J-groove.

8. The method of claim 6 further comprising configuring the first annular liner segment and the second annular liner segment to move independently of each other.

9. The method of claim 6, wherein inserting the mounting foot comprises circumferentially installing the mounting foot into the J-groove.

10. A liner assembly for placement between a mounting foot of a platform and a case of a gas turbine engine, the liner assembly comprising:

a first annular liner segment configured to be mounted on at least a portion of a radially outward surface of the mounting foot, the first annular liner segment comprising: a first flat portion; a first curved portion extending from a first end of the first annular liner segment; and a first hook portion extending around a first end of the mounting foot such that the second end of the first annular liner segment is disposed radially inward from the first end of the mounting foot;

a second annular liner segment configured to be mounted on at least a portion of a radially inward surface of the mounting foot, wherein the first annular liner segment and the second annular liner segment are configured to move independently of each other, further wherein the second annular liner segment comprises: a second flat portion; and a second curved portion extending from a first end of the second annular liner segment; and a split disposed between a second end of the first annular liner segment and a second end of the second annular liner segment, wherein the split is disposed along the radially inward surface of the mounting foot.

11. The liner assembly of claim 10, wherein the first annular liner segment and the second annular liner segment are configured to receive the mounting foot of the platform.

12. A gas turbine engine comprising:

a case with a J-groove disposed in the case, wherein the J-groove comprises an annular slot extending circumferentially within the case;

a stator mounted within the case, the stator comprising:

a vane;

a platform attached to a radially outward end of the vane;

a mounting foot mounted within the J-groove; the mounting foot including a radially outward surface, a radially inward surface, and a first end; and the liner assembly of claim 10.

13. The gas turbine engine of claim 12, wherein the case comprises a compressor case of the gas turbine engine.

14. The gas turbine engine of claim 12, wherein the first annular liner segment and the second annular liner segment are configured to receive the mounting foot of the stator.

* * * * *